US007021807B2

(12) United States Patent
Chew

(10) Patent No.: US 7,021,807 B2
(45) Date of Patent: Apr. 4, 2006

(54) SIGNAL LAMP INCORPORATING SPATIALLY SEPARATED CLUSTERED LIGHT EMITTING DEVICES

(76) Inventor: Tong Fatt Chew, Agilent Technologies (M) Sdn. Bhd. Bayan Lepas Free Industrial Zone 11900, Penang (MY)

( * ) Notice: Subject to any disclaimer, the term of this patent is extended or adjusted under 35 U.S.C. 154(b) by 176 days.

(21) Appl. No.: 10/374,268

(22) Filed: Feb. 25, 2003

(65) Prior Publication Data

US 2004/0165380 A1 Aug. 26, 2004

(51) Int. Cl.
*F21V 21/00* (2006.01)

(52) U.S. Cl. ..... 362/545; 362/541; 362/240; 362/246; 362/800

(58) Field of Classification Search ..... 362/545, 362/240, 246, 540, 252, 800, 541; 340/815, 340/45; 313/500
See application file for complete search history.

(56) References Cited

U.S. PATENT DOCUMENTS 4,808,968 A * 2/1989 Caine ..... 340/479
5,947,587 A * 9/1999 Keuper et al. ..... 362/235
6,657,393 B1 * 12/2003 Natsume ..... 315/82
6,717,526 B1 * 4/2004 Martineau et al. ..... 340/815.45
6,737,801 B1 * 5/2004 Ragle ..... 313/506
6,737,983 B1 * 5/2004 Temple ..... 340/815.45
2002/0181232 A1 * 12/2002 Martineau ..... 362/246
2003/0052594 A1 * 3/2003 Matsui et al. ..... 313/495
2003/0072153 A1 * 4/2003 Matsui et al. ..... 362/231

* cited by examiner

*Primary Examiner*—John Anthony Ward
*Assistant Examiner*—Jacob Y. Choi

(57) ABSTRACT

The invention provides a signal lamp utilizing clustered light emitting devices and method of making the same. The invention provides a signal lamp that includes a housing having an opening and including a substrate located opposite the opening, a lens disposed within the opening, and a plurality of clusters with each of the clusters comprising a plurality of light emitting devices. The clusters are disposed on the substrate to illuminate respective cluster illumination areas on the lens. Each of the cluster illumination areas has a circumference and a center. The circumference of each of the cluster illumination areas intersects the center of at least one other of the cluster illumination areas. An optical cover can be disposed over the opening.

20 Claims, 5 Drawing Sheets

SIGNAL LAMP INCORPORATING SPATIALLY SEPARATED CLUSTERED LIGHT EMITTING DEVICES

FIELD OF THE INVENTION

In general, the invention relates to signal lamps. More specifically, the invention relates to a signal lamp utilizing clustered light emitting devices and a method of making the same.

BACKGROUND OF THE INVENTION

Light emitting diodes (LEDs) are being used more frequently as a light source for signal lamps such as traffic lights. FIG. 1 is a cross sectional diagram illustrating a conventional signal lamp 100 currently in use within the industry. Signal lamp 100 includes a housing 110 having an opening 120 closed by a spreading window 130. The signal lamp 100 further includes high power LEDs 140, mounted on substrate 150, and a lens 160 located substantially parallel to the substrate 150. Lens 160 is located at a distance from the LEDs that achieves a desired homogeneous light output.

One current industry practice involves implementing the lens 160 as a Fresnel lens and locating the LEDs 140 in a region corresponding to the inner 25% of the area of lens 160. Another industry practice involves locating the LEDs 140 in a region corresponding to the inner 10% of the area of the lens 160. When an LED fails, this configuration provides a smaller reduction in the homogeneity of the brightness distribution on the surface of the spreading window 130 than in signal lamps that are not provided with a Fresnel lens and in which the LEDs are distributed on the entire area of lens.

The signal lamp 100 of FIG. 1 is susceptible to problems associated locating the high-power LEDs 140 in a region corresponding to the inner 25% of the area of the lens 160. High temperatures caused by thermal buildup can result in premature LED failure. Location of the high power LEDs 140 in the region corresponding to the inner 25% of the area of the lens 160 also requires that the lens 160 be located a greater distance from the high-power LEDs 140 to achieve a desired homogeneous light output. The greater distance results in a corresponding increase in the depth of the housing 110.

It would be desirable, therefore, to provide a signal lamp and a method of making a signal lamp that would overcome these and other disadvantages.

SUMMARY OF THE INVENTION

One aspect of the invention provides a signal lamp that includes a housing having an opening and including a substrate located opposite the opening, a lens disposed within the opening, and a plurality of clusters with each of the clusters comprising a plurality of light emitting devices. The clusters are disposed on the substrate to illuminate respective cluster illumination areas on the lens. Each of the cluster illumination areas has a circumference and a center. The circumference of each of the cluster illumination areas intersects the center of at least one other of the cluster illumination areas.

Another aspect of the invention provides a method for manufacturing a signal lamp by providing a housing having an opening and including a substrate located opposite the opening, disposing a plurality of clusters on the substrate, each of the clusters comprising a plurality of light emitting devices, and disposing a lens within the opening. The clusters are disposed on the substrate to illuminate respective cluster illumination areas on the lens. Each of the cluster illumination areas has a circumference and a center. The circumference of each of the cluster illumination areas intersects the center of at least one other of the cluster illumination areas.

Yet another aspect of the-invention provides a signal lamp that includes a housing having an opening and including a substrate located opposite the opening, a lens disposed within the opening, and a plurality of clusters, each of the clusters comprising a plurality of means for generating light. The clusters are disposed on the substrate to illuminate respective cluster illumination areas on the lens. Each of the cluster illumination areas has a circumference and a center. The circumference of each of the cluster illumination areas intersects the center of at least one other of the cluster illumination areas.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENT

Figure 1:
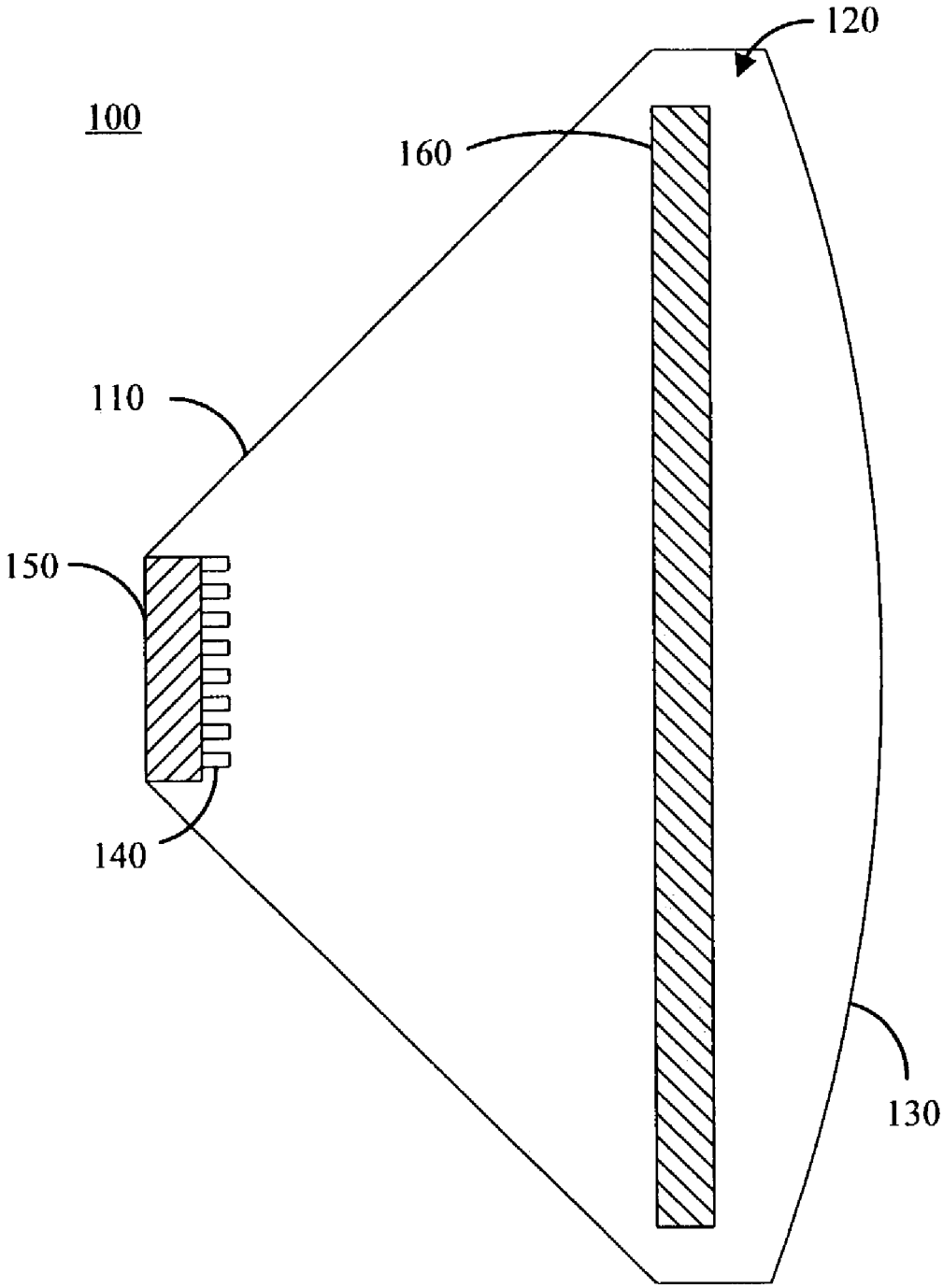
FIG. 1 (PRIOR ART)
FIG. 1 is a cross sectional diagram illustrating a conventional signal lamp.
Figure 2:
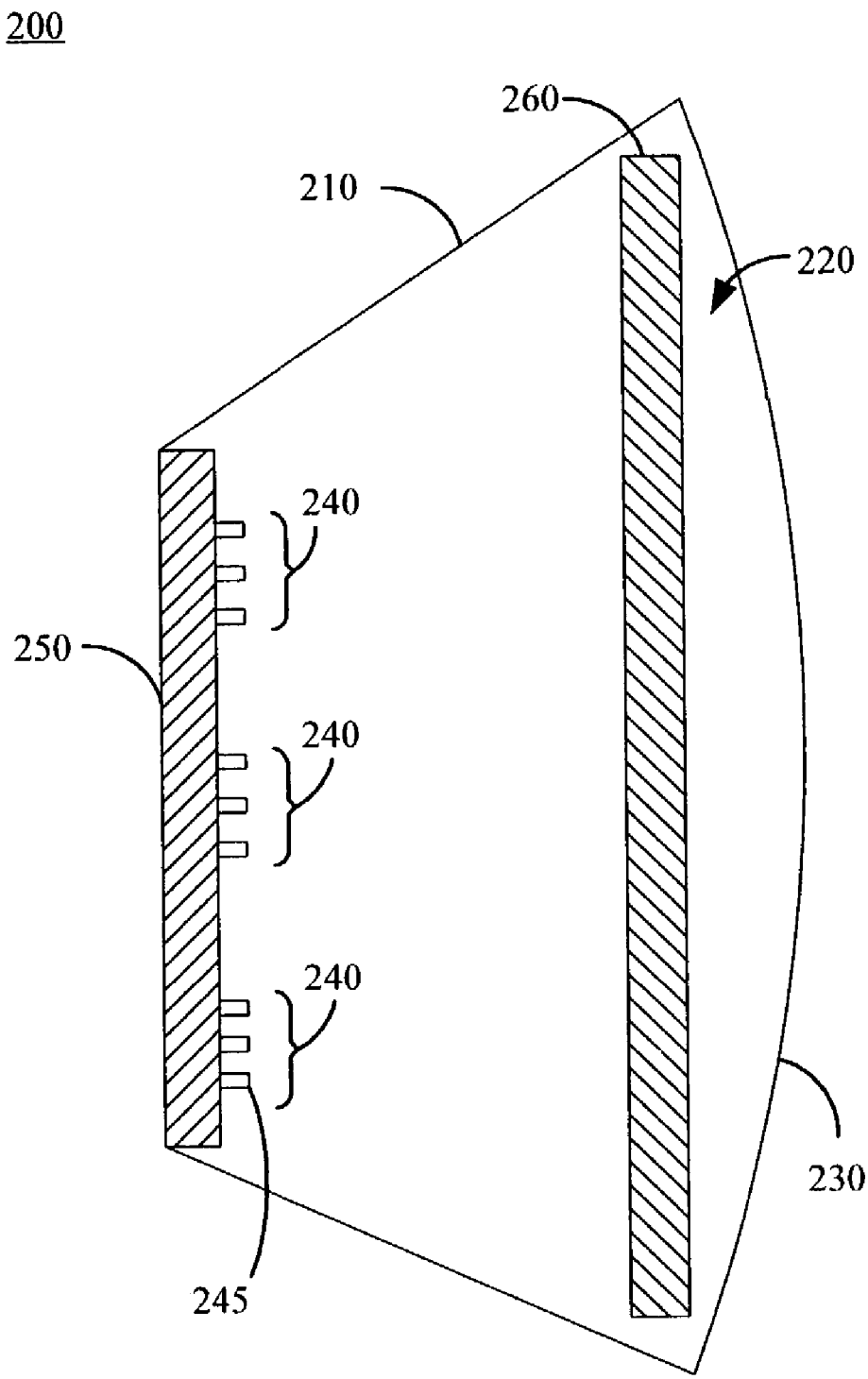
FIG. 2 is a cross sectional diagram illustrating a signal lamp according to an embodiment of the present invention.

FIG. 2 is a cross sectional diagram illustrating a signal lamp according to an embodiment of the present invention. Signal lamp 200, which produces a desired homogeneous light output, includes housing 210, optical cover 230, light emitting devices of which an exemplary one is shown at 245, substrate 250, and a lens 260. The housing 210 includes an opening 220 that is closed by the optical cover 230. The combination of the optical cover 230 and the housing 210 is called a signal head.

The substrate 250 is located opposite opening 220 and is mounted on the inner surface of the housing 210. The light emitting devices 245 are mounted on the substrate 250 and grouped together in a plurality of clusters 240. The clusters 240 are spatially separated from one another on the substrate by distances substantially greater than the spatial separation of the light emitting devices 245 in each of the clusters. The lens 260 is supported by the inner surface of the housing 210 and is located within the opening 220 between the substrate 250 and the optical cover 230, such that the lens 260 is optically coupled to the light emitting devices 245 and the optical cover 230.

The housing 210 can be manufactured from any suitable material providing support for and enclosure of the various components. For example, the housing 210 may be manufactured from a light-absorbing, synthetic-resin material. In one embodiment, the housing 210 is manufactured from polycarbonate.

The optical cover 230 provides protection for the internal elements within the housing 210. The optical cover 230 may additionally modify light output from the signal lamp 200. The optical cover 230 can be clear, or can be tinted to modify the color of the light output from the signal lamp 200 to a desired color. The optical cover 230 can be a transparent or semi-transparent pane to let the light pass through, or be a lens, diffuser, grating, mask, or the like, to modify one or more characteristics of the light output from the light emitting devices 245. The optical cover 230 can be manufactured from any transparent or semi-transparent material, such as polycarbonate, polystyrene, acrylic, glass, polypropylene, or the like. Alternatively, the optical cover 230 can be omitted from the signal lamp 200 and the lens 260 can be used to close the front of the housing 210.

In one embodiment, the surface of the optical cover 230 is patterned to alter the directional properties of the light output by the signal lamp 200. In another embodiment, the surface of the optical cover 230 is curved. In yet another embodiment, the optical cover 230 is a filter, receiving light from the lens 260, filtering the light, and emitting the filtered light. In yet another embodiment, the optical cover 230 is impregnated or coated with a luminescent material, such as a phosphor compound, which absorbs light at one wavelength and emits light at another wavelength.

The light emitting devices 245 are the light source of the signal lamp 200. In one embodiment, the light emitting devices 245 are implemented as a light-emitting diodes (LEDs), such as a visible light-emitting diodes (LEDs) or ultraviolet (UV) light-emitting diodes (LEDs). In another embodiment, light emitting devices 245 are laser diodes, such as laser diodes that emit visible light or ultraviolet (UV) light.

The lens 260 refracts light received from the light emitting devices 245. The lens 260 can be clear or tinted to produce the desired color light from the signal lamp 200. The lens 260 can include multiple lenses or lens elements, diffusers, gratings, masks, or the like, to alter the properties of the light output from the light emitting devices 245. In one embodiment, the lens 260 collimates the light from the light emitting devices 245. In another embodiment, the lens 260 is a simple lens, a multi-prismed lens such as a Fresnel lens, or a multi-element lens. The lens 260 can be manufactured from any transparent or semi-transparent material, such as polycarbonate, polystyrene, acrylic, glass, polypropylene, or the like.

In the example shown in FIG. 2, a plurality of light emitting devices 245 is located within each cluster 240. As a result, failure of a single light emitting device has minimal effect on light output. Distributing the light emitting devices 245 in clusters 240 spread over the substrate 250 allows a reduction in the distance between the lens 260 and the light emitting devices 245, with a corresponding reduction in the depth of the housing 210.

Figure 3:
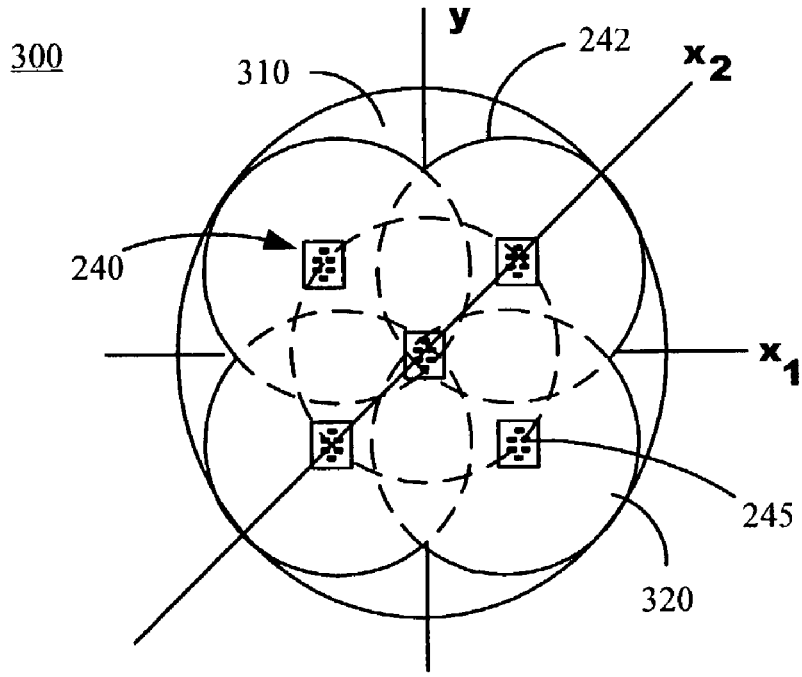
FIG. 3 is a front view of a signal lamp in an exemplary embodiment of the present invention.
Figure 5A:
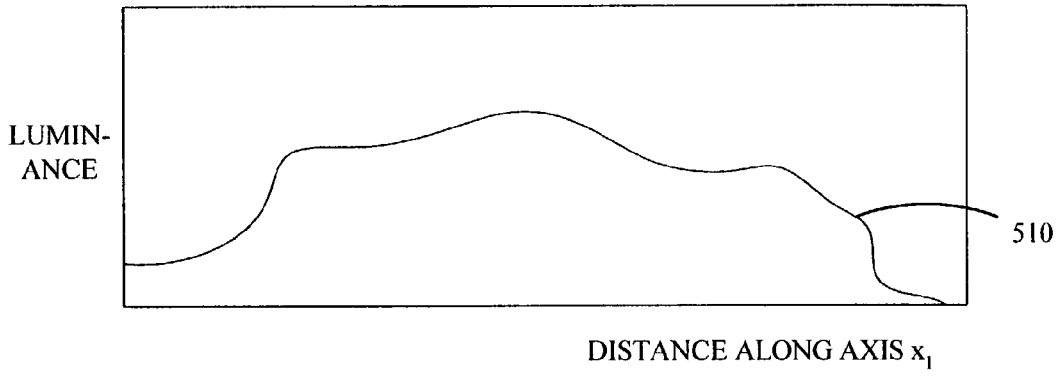
FIGS. 5A & 5B are graphs illustrating the luminance distribution of the cluster configuration shown in FIG. 3 along axes $x_1$ and $x_2$, respectively.
Figure 5B:
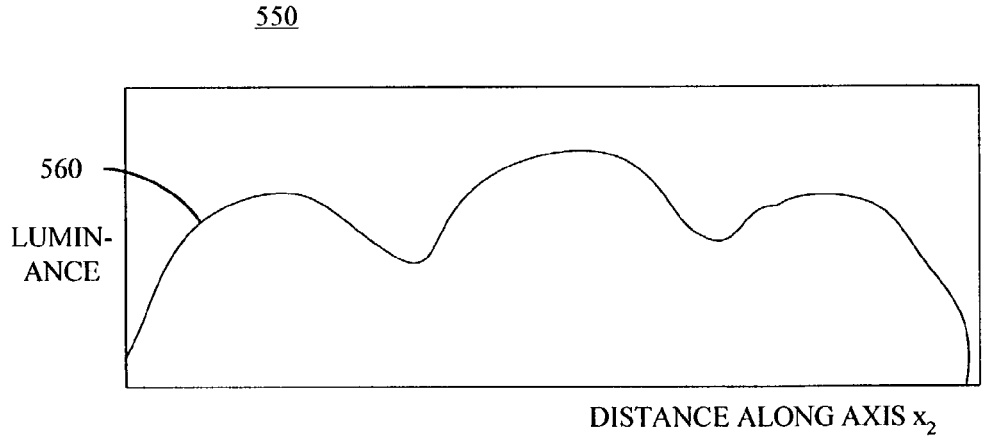

FIG. 3 is a front view of signal lamp 200 in an exemplary embodiment of the present invention. The cover 230 and lens 260 have been removed to show the cluster configuration 300 more clearly. Each cluster 240 has a corresponding cluster illumination area 320 and includes a plurality of light emitting devices of which an exemplary one is shown at 245. In one embodiment, the light emitting devices 245 within each cluster 240 are arranged in a symmetrical pattern. In another embodiment, the light emitting devices 245 within the clusters 240 are arranged in an asymmetrical pattern. FIG. 3 also shows an $x_1$ axis and an $x_2$ axis along which relative light intensity is shown in FIGS. 5A and 5B below.

The cluster configuration 300 illustrates the distribution of the light generated by the light emitting devices 245 on the lens area 310. The clusters 240 are mounted on a substrate (not shown). Each of the clusters 240 generates light that fills a corresponding cluster illumination area 320. The cluster illumination areas 320 cover the lens area 310, which lies in the plane of the lens 260 (FIG. 2). The lens area 310 represents the approximate area of the lens 260 used in the signal lamp.

Referring to FIG. 3, each cluster illumination area 320 includes a circumference 242 and a center (not shown). The circumference 242 of each cluster illumination area 320 intersects at least one other of the cluster illumination areas 320 near the center of the other cluster illumination area. The clusters 240 are designed to provide a desired illumination at the circumference 242. In one embodiment, the circumference 242 represents the half-intensity contour of the light of the cluster illumination area 320.

The cluster illumination areas 320 represent regions of the lens area 310 illuminated by light from their respective clusters 240. In the example shown in FIG. 3, the lens area 310 includes five cluster illumination areas 320. Each corresponding cluster 240 has six light emitting devices 245, which are arranged in a symmetric pattern. A homogeneous light output is obtained by locating the clusters 240 such that the light generated by the clusters passes through a majority of the lens area 310. Separation of light emitting devices 245 into the clusters 240 increases heat transfer from the light emitting devices 245 and therefore reduces the operating temperature of the light emitting devices.

Each cluster 240 includes a plurality of light emitting devices 245, so homogeneous light output is maintained even if one or more of the light emitting devices fails. In one example, the cluster configuration 300 includes thirty light emitting devices 245 configured within five clusters 240. Each cluster 240 includes six light emitting devices 245, so failure of a single light emitting device 245 within a cluster 240 would only reduce the light output of the associated cluster illumination area 320 by ⅙ or 17%.

FIGS. 5A & 5B are graphs 500, 550 illustrating the luminance distribution of the cluster configuration shown in FIG. 3 along axes $x_1$ and $x_2$, respectively. Luminance is a measure of brightness per unit area and is typically measured in candela per square meter. In the graphs, the relative luminance 510, 560 is indicated as a function of the distance along the respective axis.

Figure 4:
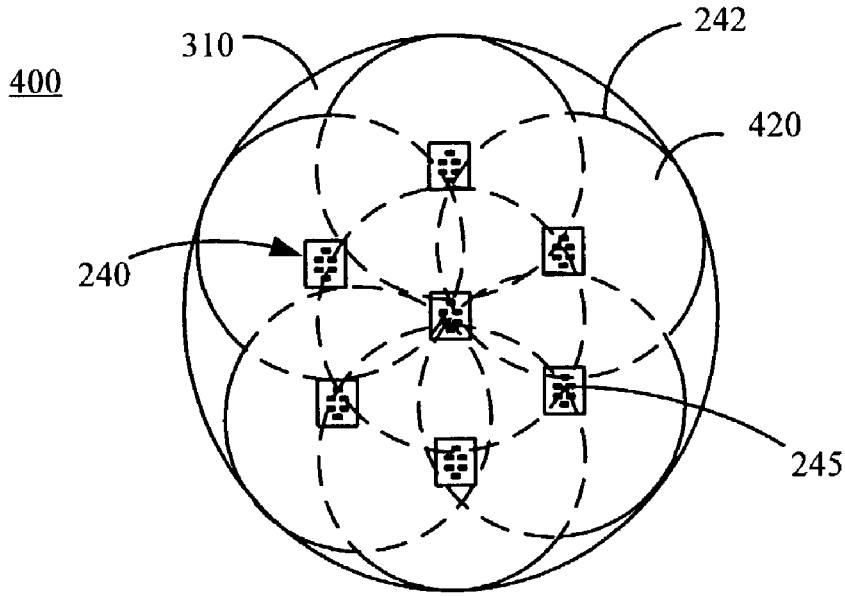
FIG. 4 is a front view illustrating a cluster configuration of a signal lamp according to another embodiment of the present invention.

FIG. 4, in which like elements share like reference numbers with FIG. 3, is a front view illustrating a cluster configuration of a signal lamp according to another embodiment of the present invention. Each cluster 240 corresponding to each cluster illumination area 420 includes a plurality of light emitting devices of which an exemplary one is shown at 245. In one embodiment, the light emitting devices 245 within each cluster 240 are arranged in a symmetrical pattern. In another embodiment, the light emitting devices 245 within the clusters 240 are arranged in an asymmetrical pattern.

The cluster configuration 400 illustrates the distribution of light on the lens area 310. The clusters 240 are mounted on a substrate (not shown). Each of the clusters 240 generates light that fills a corresponding cluster illumination area 420. The cluster illumination areas 420 occur at the lens area 310, which lies in the plane of the lens 260 (FIG. 2). The lens area 310 represents the approximate area of the lens 260 used in the signal lamp.

Referring to FIG. 4, each cluster illumination area 420 includes a circumference 242 and a center (not shown). The circumference 242 of each cluster illumination area 420 intersects at least one other of the cluster illumination areas 420 near the center of the other of the cluster illumination areas. The clusters 240 are designed to provide a desired illumination at the circumference 242. In one embodiment, the circumference 242 represents the half-intensity contour of the light of the cluster illumination area 420.

The cluster illumination areas 420 represent regions of the lens area 310 illuminated by light from their respective clusters 240. In the example shown in FIG. 4, the lens area 310 includes seven cluster illumination areas 420. Each corresponding cluster 240 has six light emitting devices 245, which are arranged in a symmetrical pattern. A homogeneous light output is obtained by locating the clusters 240 such that their light passes through a greater part of the lens area 310. Separation of the clusters 240 increases heat transfer from the light emitting devices 245 and therefore reduces the operating temperature of the light emitting devices.

Each cluster 240 includes a plurality of light emitting devices 245, so homogeneous light output is maintained even if one or more of the light emitting devices fails. In one example, the cluster configuration 400 includes forty-two light emitting devices 245 configured within seven clusters 240.

Figure 6:
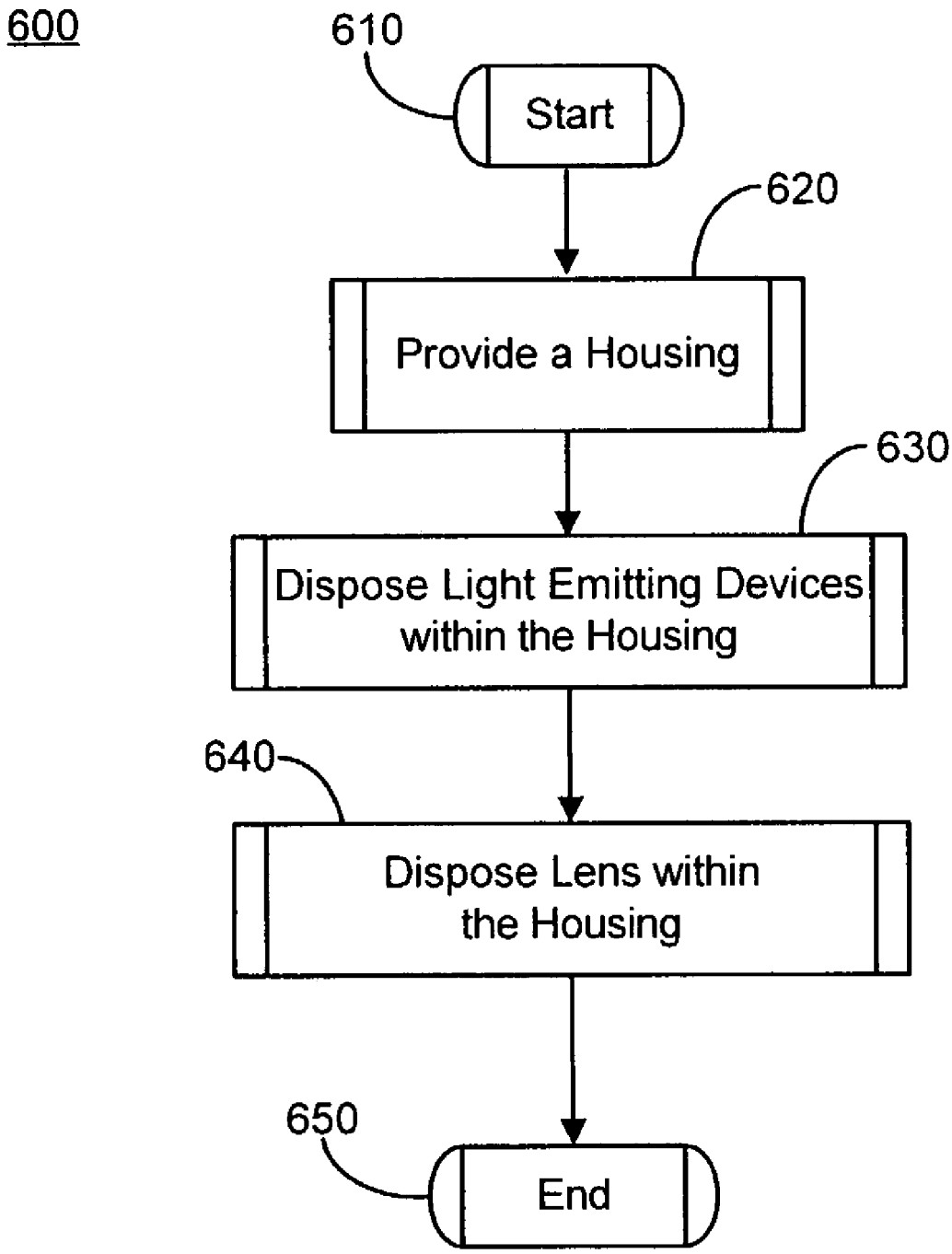
FIG. 6 is a flow diagram depicting an exemplary method of manufacturing a signal lamp in accordance with the present invention.

FIG. 6 is a flow diagram depicting an exemplary method of manufacturing a signal lamp in accordance with the present invention.

Method 600 begins at block 610. At block 620, a housing is provided. The housing includes an opening, a lens area, and a substrate. The substrate is located opposite the opening.

At block 630, each of a plurality of light emitting devices is disposed in clusters on the substrate. In one embodiment, light emitting devices within each cluster are arranged symmetrically. In another embodiment, light emitting devices within each cluster are arranged asymmetrically. The light emitting devices can be light-emitting diodes, visible light-emitting diodes, ultraviolet (UV) light-emitting diodes, laser diodes, visible light laser diodes, or ultraviolet (UV) laser diodes.

Each cluster is located on the substrate so that the light from each cluster illuminates a cluster illumination area on the lens area. Each of the plurality of cluster illumination areas has a circumference and a center. The circumference of each of the plurality of cluster illumination areas intersects the center of at least one other of the plurality of cluster illumination areas.

At block 640, a lens is disposed at the lens area of the housing. In one embodiment, the lens is supported by the housing and located between the substrate and the opening, such that the lens is optically coupled to the light emitting devices. The lens can be a simple lens, a multi-prismed lens, a Fresnel lens, a multi-element lens, a filter, a diffuser, a grating, or a mask. The lens can be made of polycarbonate, polystyrene, acrylic, glass, or polypropylene.

In an optional embodiment, an optical cover is disposed over the opening of the housing. In one embodiment, the optical cover closes the opening, provides protection for internal elements within the housing, and may modify the signal lamp light output. The optical cover can be a transparent or semi-transparent pane, or can be a lens, filter, diffuser, grating, or mask. The optical cover can be made of polycarbonate, polystyrene, acrylic, glass, or polypropylene. At block 650, the method ends.

The signal lamp and method of making the same discussed above illustrate possible approaches to a signal lamp utilizing clustered light emitting devices. The actual implementation may vary from that discussed. Moreover, various other improvements and modifications to this invention may occur to those skilled in the art, and those improvements and modifications will fall within the scope of this invention as set forth in the claims below.

The present invention may be embodied in other specific forms without departing from its essential characteristics. The described embodiments are to be considered in all respects only as illustrative and not restrictive.

I claim:

1. A signal lamp comprising:

a housing having an opening and including a substrate, the substrate located opposite the opening;

a lens disposed within the opening; and a plurality of clusters, each of the plurality of clusters comprising a plurality of light emitting devices;

wherein the clusters are disposed on the substrate to illuminate respective cluster illumination areas on the lens, each of the cluster illumination areas having a circumference and a center, the circumference of each of the cluster illumination areas intersecting the center of at least one other of the cluster illumination areas.

2. The signal lamp of claim 1, wherein the cluster illumination areas cover a majority of the area of the lens.

3. The signal lamp of claim 1, further comprising an optical cover disposed over the opening.

4. The signal lamp of claim 3, wherein the optical cover is selected from the group consisting of a transparent pane, a semi-transparent pane, a lens, a filter, a diffuser, a grating, and a mask.

5. The signal lamp of claim 3, wherein the optical cover is manufactured from a material selected from the group consisting of polycarbonate, polystyrene, acrylic, glass, and polypropylene.

6. The signal lamp of claim 1, wherein the lens is selected from the group consisting of a simple lens, a multi-prismed lens, a Fresnel lens, a multi-element lens, a filter, a diffuser, a grating, and a mask.

7. The signal lamp of claim 1, wherein the lens is manufactured from a material selected from the group consisting of polycarbonate, polystyrene, acrylic, glass, and polypropylene.

8. The signal lamp of claim 1, wherein the light emitting devices are selected from the group consisting of light-emitting diodes, visible light-emitting diodes, ultraviolet (UV) light-emitting diodes, laser diodes, visible light laser diodes, and ultraviolet (UV) laser diodes.

9. The signal lamp of claim 1, wherein the light emitting devices are arranged symmetrically in the cluster.

10. A method for manufacturing a signal lamp, the method comprising:

providing a housing, the housing having an opening and including a substrate, the substrate located opposite the opening;

disposing a plurality of clusters on the substrate, each of the clusters comprising a plurality of light emitting devices; and disposing a lens within the opening;

wherein the clusters are disposed on the substrate to illuminate respective cluster illumination areas on the lens, each of the cluster illumination areas having a circumference and a center, the circumference of each of the cluster illumination areas intersecting the center of at least one other of the cluster illumination areas.

11. The method of claim 10, further comprising arranging the clusters so that the cluster illumination areas cover a majority of the area of the lens.

12. The method of claim 10, further comprising disposing an optical cover over the opening.

13. The method of claim 12, wherein the optical cover is selected from the group consisting of a transparent pane, a semi-transparent pane, a lens, a filter, a diffuser, a grating, and a mask.

14. The method of claim 12, wherein the optical cover is manufactured from a material selected from the group consisting of polycarbonate, polystyrene, acrylic, glass, and polypropylene.

15. The method of claim 10, wherein the lens is selected from the group consisting of a simple lens, a multi-prismed lens, a Fresnel lens, a multi-element lens, a filter, a diffuser, a grating, and a mask.

16. The method of claim 10, wherein the lens is manufactured from a material selected from the group consisting of polycarbonate, polystyrene, acrylic, glass, and polypropylene.

17. The method of claim 10, wherein the light emitting devices are selected from the group consisting of light-emitting diodes, visible light-emitting diodes, ultraviolet (UV) light-emitting diodes, laser diodes, visible light laser diodes, and ultraviolet (UV) laser diodes.

18. The method of claim 10, further comprising arranging the light emitting devices symmetrically in the cluster.

19. A signal lamp comprising:

a housing having an opening and including a substrate, the substrate located opposite the opening;

a lens disposed within the opening; and a plurality of clusters, each of the clusters comprising a plurality of means for generating light;

wherein the clusters are disposed on the substrate to illuminate respective cluster illumination areas on the lens, each of cluster illumination areas having a circumference and a center, the circumference of each of the cluster illumination areas intersecting the center of at least one other of the cluster illumination areas.

20. The signal lamp of claim 19, further comprising means for covering the opening.

* * * * *